US011732224B2

(12) United States Patent
Schmiedel et al.

(10) Patent No.: US 11,732,224 B2
(45) **Date of Patent: *Aug. 22, 2023**

(54) SOLID PERFUME-CONTAINING COMPOSITION

(71) Applicant: Henkel AG & Co. KGaA, Duesseldorf (DE)

(72) Inventors: Peter Schmiedel, Duesseldorf (DE); Danilo Panzica, Hilden (DE); Bernd Larson, Erkelenz (DE); Thomas Holderbaum, Hilden (DE); Luca Bellomi, Duesseldorf (DE); Dieter Nickel, Pulheim (DE); Regina Stehr, Neuss (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 212 days.

This patent is subject to a terminal disclaimer.

(21) Appl. No.: 16/858,482

(22) Filed: Apr. 24, 2020

(65) Prior Publication Data

US 2020/0255776 A1 Aug. 13, 2020

Related U.S. Application Data

(63) Continuation of application No. PCT/EP2018/078313, filed on Oct. 17, 2018.

(51) Int. Cl.

| | |
|---|---|
| ***C11D 17/00*** | (2006.01) |
| ***C11D 17/06*** | (2006.01) |
| ***C11D 3/08*** | (2006.01) |
| ***C11D 3/20*** | (2006.01) |
| ***C11D 3/22*** | (2006.01) |
| ***C11D 3/40*** | (2006.01) |
| ***C11D 3/50*** | (2006.01) |
| ***C11D 11/00*** | (2006.01) |

(52) U.S. Cl.

CPC ..... *C11D 17/06* (2013.01); *C11D 3/08* (2013.01); *C11D 3/202* (2013.01); *C11D 3/2079* (2013.01); *C11D 3/222* (2013.01); *C11D 3/40* (2013.01); *C11D 3/50* (2013.01); *C11D 3/505* (2013.01); *C11D 11/0017* (2013.01); *C11D 11/0023* (2013.01)

(58) Field of Classification Search

CPC ..... C11D 11/0017; C11D 3/046; C11D 17/06; C11D 3/50; C11D 17/044; C11D 3/08

See application file for complete search history.

(56) References Cited

U.S. PATENT DOCUMENTS

| | | | | |
|---|---|---|---|---|
| 2006/0030513 | A1* | 2/2006 | Binder | C11D 3/373 510/515 |
| 2013/0326824 | A1* | 12/2013 | Somerville Roberts | C11D 3/2093 8/137 |
| 2017/0218312 | A1* | 8/2017 | Panandiker | C11D 1/29 |

FOREIGN PATENT DOCUMENTS

| | | | |
|---|---|---|---|
| DE | 102008031212 | A1 | 1/2010 |
| DE | 102009029292 | A1 | 3/2011 |

OTHER PUBLICATIONS

PCT International Search Report & Written Opinion PCT/EP2018/078313 Completed: Jan. 17, 2019 dated Jan. 25, 2019.

* cited by examiner

*Primary Examiner* — John R Hardee

(74) *Attorney, Agent, or Firm* — Thomas G. Krivulka

(57) ABSTRACT

A solid, particulate composition having at least one water-soluble carrier material, at least one fragrance and at least one rheology modifier, wherein the carrier material is a water-containing salt (hydrate) whose water vapor partial pressure at a specific temperature in the range from 30 to 100° C. corresponds to the $H_2O$ partial pressure of the saturated solution of this salt, such that the salt melts at this temperature in its own crystal water. The invention further relates to processes for producing the solid composition, and to a washing or cleaning product including the solid composition. In addition, the present invention also relates to the use of a washing or cleaning product of this kind for cleaning of textiles or hard surfaces, and corresponding methods of cleaning textiles or hard surfaces using a washing or cleaning product of this kind.

16 Claims, No Drawings

SOLID PERFUME-CONTAINING COMPOSITION

FIELD OF THE INVENTION

The present invention relates to a solid, particulate composition comprising at least one water-soluble carrier material, at least one rheology modifier and at least one fragrance, the carrier material being a water-containing salt (hydrate) of which the water vapor partial pressure, at a specific temperature in the range of from 30 to 100° C., corresponds to the $H_2O$ partial pressure of the saturated solution of this salt, such that the salt melts at this temperature in its own water of crystallization. Furthermore, the invention relates to methods for preparing the solid composition and to a washing or cleaning agent containing the solid composition. Moreover, the present invention also relates to the use of such a washing or cleaning agent for cleaning textiles or hard surfaces and corresponding methods for cleaning textiles or hard surfaces using such a washing or cleaning agent.

BACKGROUND OF THE INVENTION

When using washing and cleaning agents, the consumer not only aims to wash, clean or care for the objects to be treated, but also wishes that after treatment, for example after washing, the treated objects, such as textiles, have a pleasant smell. For this reason in particular, most commercially available washing and cleaning agents contain fragrances.

Fragrances are often used in the form of fragrance particles, either as an integral constituent of a washing or cleaning agent or dosed into the washing drum right at the beginning of a wash cycle in a separate form. In this way, the consumer can control the fragrancing of the laundry to be washed by individual dosage.

The main constituent of such fragrance pastilles known in the prior art is typically a water-soluble or at least water-dispersible carrier polymer, such as polyethylene glycol (PEG), which is used as a vehicle for the integrated fragrances and which dissolves more or less completely in the wash liquor during the waxing process, so as to release the fragrances contained and, optionally, other components into the wash liquor. For the preparation of the known fragrance pastilles, a melt is produced from the carrier polymer, which melt contains the remaining ingredients or these are then added, and the resulting melt is then fed to a shaping process, in the course of which it cools, solidifies and assumes the desired shape.

BRIEF SUMMARY OF THE INVENTION

The known products have the disadvantage that the polymer materials used, in particular PEG, have delayed solubility, which can lead to residues on the laundry or in the washing machine, in particular in the case of short wash cycles, low temperature or other unfavorable conditions.

However, it has now been found that an alternative composition which exhibits a suitable processing range and at the same time has improved water solubility in the usual temperature ranges in which work is carried out can be provided by a water-containing salt (hydrate) being used as the carrier material in a formulation for melting bodies, the water vapor partial pressure of which salt corresponds, at a specific temperature in the range of from 30 to 100° C., to the $H_2O$ partial pressure of the saturated solution of this salt at the same temperature, such that the salt dissolves at this temperature in its own water of crystallization, a process which phenomenologically can be referred to as melting, which is thermodynamic but is a solution process. The use of sodium acetate trihydrate is particularly advantageous.

These specific carrier materials are processed preferably by means of a process in the course of which the salts are provided as melts and subsequently are added dropwise to a cooling belt, for example by means of a nozzle, on which cooling belt the salts solidify and assume a final geometric shape. In the processing, for example in the dropwise adding of the above-mentioned melts to solidified particles, there were technical difficulties with regard to the reliable production of uniform particles having a defined geometry and a sufficient breaking strength for production, packaging and transport. This resulted in difficulties in the design of the production facility and with regard to achieving a uniform product appearance.

It has been found that these disadvantages can be prevented, irrespective of the duration of the solidification process, by adhering to specific rheological properties of the melt.

In a first aspect, the present invention is therefore directed to a solid, particulate composition comprising (a) 20 to 95 wt. %, based on the total weight of the composition, of at least one water-soluble carrier material selected from water-containing salts of which the water vapor partial pressure corresponds, at a specific temperature in the range of from 30 to 100° C., to the $H_2O$ partial pressure of the saturated solution of said salt, preferably sodium acetate trihydrate ($Na(CH_3COO).3H_2O$);

(b) 0.1 to 20 wt. % of at least one fragrance, (c) 0.1 to 25 wt. %, based on the total weight of the composition, of at least one, preferably solid, rheology modifier of such a type and in such an amount that a melt obtained by heating the composition to 70° C. has a yield point above 1 Pa, preferably above 5 Pa and in particular above 10 Pa;

(d) optionally up to 25 wt. %, based on the total weight of the composition, of an emulsifier, preferably an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines, or combinations thereof;

(e) optionally up to 25 wt. %, based on the total weight of the composition, of at least one solid or filler that is different from (c) and (d); and (f) optionally at least one dye.

In a second aspect, the invention is directed to a solid, particulate composition comprising (a) 20 to 95 wt. %, based on the total weight of the composition, sodium acetate and/or a hydrate thereof and optionally water, with the proviso that when sodium acetate is used, water is used in an amount which would theoretically be necessary, based on the amount, to ensure that at least 60 wt. % of the total amount of sodium acetate and its hydrates is in the form of sodium acetate trihydrate;

(b) 0.1 to 20 wt. % of at least one fragrance, (c) 0.1 to 25 wt. %, based on the total weight of the composition, of at least one, preferably solid, rheology modifier of such a type and in such an amount that a melt obtained by heating the composition to 70° C. has a yield point above 1 Pa, preferably above 5 Pa and in particular above 10 Pa;

(d) optionally up to 25 wt. %, based on the total weight of the composition, of an emulsifier, preferably an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines, or combinations thereof;

(e) optionally up to 25 wt. %, based on the total weight of the composition, of at least one solid or filler that is different from (c) and (d); and (f) optionally at least one dye.

In a third aspect, the invention is directed to a solid, particulate composition comprising (a) 12 to 57 wt. %, based on the total weight of the composition, sodium acetate; (b) 0.1 to 10 wt. % of at least one fragrance;

(c) 0.1 to 25 wt. %, based on the total weight of the composition, of at least one, preferably solid, rheology modifier of such a type and in such an amount that a melt obtained by heating the composition to 70° C. has a yield point above 1 Pa, preferably above 5 Pa and in particular above 10 Pa;

(d) optionally up to 25 wt. %, based on the total weight of the composition, of an emulsifier, preferably an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines, or combinations thereof;

(e) optionally up to 25 wt. %, based on the total weight of the composition, of at least one solid or filler that is different from (c) and (d);

(f) optionally at least one dye; and (g) water in an amount that is sufficient to convert at least 60 wt. %, preferably at least 70 wt. %, more preferably at least 80 wt. %, most preferably at least 100 wt. %, of the sodium acetate (a) to sodium acetate trihydrate.

In a fourth aspect, the invention is directed to a solid, particulate composition comprising (a) 20 to 95 wt. %, based on the total weight of the composition, sodium acetate trihydrate;

(b) 0.1 to 10 wt. % of at least one fragrance;

(c) 0.1 to 25 wt. %, based on the total weight of the composition, of at least one, preferably solid, rheology modifier of such a type and in such an amount that a melt obtained by heating the composition to 70° C. has a yield point above 1 Pa, preferably above 5 Pa and in particular above 10 Pa;

(d) optionally up to 25 wt. %, based on the total weight of the composition, of an emulsifier, preferably an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines, or combinations thereof;

(e) optionally up to 25 wt. %, based on the total weight of the composition, of at least one solid or filler that is different from (c) and (d); and (f) optionally at least one dye.

In a fifth aspect, the present invention is therefore directed to a solid, particulate composition comprising (a) 20 to 95 wt. %, based on the total weight of the composition, of at least one water-soluble carrier material selected from water-containing salts of which the water vapor partial pressure corresponds, at a specific temperature in the range of from 30 to 100° C., to the $H_2O$ partial pressure of the saturated solution of said salt, preferably sodium acetate trihydrate ($Na(CH_3COO).3H_2O$);

(b) 0.1 to 20 wt. % of at least one fragrance, (c) 0.1 to 25 wt. %, preferably 0.5 to 3 wt. %, based on the total weight of the composition, of an inorganic rheology modifier, preferably an inorganic rheology modifier from the group of pyrogenic silicic acids and/or of an organic rheology modifier, preferably an organic rheology modifier from the group of celluloses, preferably microfibrillated celluloses;

(d) optionally up to 25 wt. %, preferably 0.5 to 3 wt. %, based on the total weight of the composition, of an inorganic rheology modifier, preferably of an inorganic rheology modifier from the group of pyrogenic silicic acids;

(e) optionally up to 25 wt. %, preferably 0.5 to 3 wt. %, based on the total weight of the composition, of an organic rheology modifier, preferably an organic rheology modifier from the group of celluloses, preferably microfibrillated celluloses;

(f) optionally up to 25 wt. %, based on the total weight of the composition, of an emulsifier, preferably an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines, or combinations thereof;

(g) optionally up to 25 wt. %, based on the total weight of the composition, of at least one solid or filler that is different from (c) and (d); and (h) optionally at least one dye.

In a sixth aspect, the invention is directed to a solid, particulate composition comprising (a) 20 to 95 wt. %, based on the total weight of the composition, sodium acetate and/or a hydrate thereof and optionally water, with the proviso that when sodium acetate is used, water is used in an amount which would theoretically be necessary, based on the amount, to ensure that at least 60 wt. % of the total amount of sodium acetate and its hydrates is in the form of sodium acetate trihydrate;

(b) 0.1 to 20 wt. % of at least one fragrance, (c) 0.1 to 25 wt. %, preferably 0.5 to 3 wt. %, based on the total weight of the composition, of an inorganic rheology modifier, preferably an inorganic rheology modifier from the group of pyrogenic silicic acids and/or of an organic rheology modifier, preferably an organic rheology modifier from the group of celluloses, preferably microfibrillated celluloses;

(d) optionally up to 25 wt. %, based on the total weight of the composition, of an emulsifier, preferably an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines, or combinations thereof;

(e) optionally up to 25 wt. %, based on the total weight of the composition, of at least one solid or filler that is different from (c) and (d); and (f) optionally at least one dye.

In a seventh aspect, the invention is directed to a solid, particulate composition comprising (a) 12 to 57 wt. %, based on the total weight of the composition, sodium acetate;

(b) 0.1 to 10 wt. % of at least one fragrance;

(c) 0.1 to 25 wt. %, preferably 0.5 to 3 wt. %, based on the total weight of the composition, of an inorganic rheology modifier, preferably an inorganic rheology modifier from the group of pyrogenic silicic acids and/or of an organic rheology modifier, preferably an organic rheology modifier from the group of celluloses, preferably microfibrillated celluloses;

(d) optionally up to 25 wt. %, based on the total weight of the composition, of an emulsifier, preferably an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines, or combinations thereof;

(e) optionally up to 25 wt. %, based on the total weight of the composition, of at least one solid or filler that is different from (c) and (d);

(f) optionally at least one dye; and (g) water in an amount that is sufficient to convert at least 60 wt. %, preferably at least 70 wt. %, more preferably at least 80 wt. %, most preferably at least 100 wt. %, of the sodium acetate (a) to sodium acetate trihydrate.

In an eighth aspect, the invention is directed to a solid, particulate composition comprising (a) 20 to 95 wt. %, based on the total weight of the composition, sodium acetate trihydrate;

(b) 0.1 to 10 wt. % of at least one fragrance;

(c) 0.1 to 25 wt. %, preferably 0.5 to 3 wt. %, based on the total weight of the composition, of an inorganic rheology modifier, preferably an inorganic rheology modifier from the group of pyrogenic silicic acids and/or of an organic rheology modifier, preferably an organic rheology modifier from the group of celluloses, preferably microfibrillated celluloses;

(d) optionally up to 25 wt. %, based on the total weight of the composition, of an emulsifier, preferably an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines, or combinations thereof;

(e) optionally up to 25 wt. %, based on the total weight of the composition, of at least one solid or filler that is different from (c) and (d); and (f) optionally at least one dye.

In yet another aspect, the present invention is directed to the use of the solid composition as described herein as a textile care agent, preferably a fragrance, for fragrancing textile fabrics.

In another aspect, the present invention is further directed to a washing or cleaning agent comprising a solid composition as described herein.

These and other aspects, features, and advantages of the invention will become apparent to a person skilled in the art through the study of the following detailed description and claims. Any feature from one aspect of the invention can be used in any other aspect of the invention. In particular, it is intended that all preferred embodiments described herein can be transferred to all aspects of the invention or be combined therewith. This is especially true for the first to eighth aspect of the invention as described above. Furthermore, it will readily be understood that the examples contained herein are intended to describe and illustrate but not to limit the invention and that, in particular, the invention is not limited to these examples.

DETAILED DESCRIPTION OF THE INVENTION

Unless indicated otherwise, all percentages are indicated in terms of wt. %. Numerical ranges that are indicated in the format "from x to y" also include the stated values. If several preferred numerical ranges are indicated in this format, it is self-evident that all ranges that result from the combination of the various endpoints are also included.

"At least one," as used herein, refers to 1 or more, for example 1, 2, 3, 4, 5, 6, 7, 8, 9 or more. In particular, this expression refers to the type of agent/compound and not to the absolute number of molecules. "At least one fragrance," therefore, means that at least one type of fragrance is included but also that two or more different types of fragrances may be contained.

"About" or "approximately," as used herein in connection with a numerical value, refers to the numerical value ±10%, preferably ±5%. A temperature of approximately 50° C. thus means 45-55° C., preferably 47.5-52.5° C.

"Water-soluble," as used herein, means a solubility in water at 20° C. of at least 1 g/L, preferably at least 10 g/L, more preferably at least 50 g/L.

The solid, particulate composition as described herein is prepared from a solution of the carrier material in the water/water of crystallization contained in the composition, where for such a solution the term "melt" is also used herein, in contrast to the established use, to refer to the state in which the carrier material dissolves by eliminating water in its own water of crystallization and thus forms a liquid. The term "melt" as used herein therefore refers to the liquid state of the composition which results when the temperature at which the carrier material eliminates water of crystallization and then dissolves in the water contained in the composition is exceeded. The corresponding dispersion containing the herein described (solid) substances dispersed in the melt of the carrier material is therefore also subject matter of the invention. Thus, when reference is made in the following to the solid, particulate composition, the corresponding melt/melt dispersion from which it is obtainable is always included. Since these do not differ in composition except for the state of matter, the terms are used interchangeably herein.

The term "melt body" is used herein to describe the solid particles obtainable from the liquid composition upon cooling by solidification/reshaping.

The main component of the solid particulate composition as described herein is at least one water-soluble carrier material. The at least one carrier material is characterized in that it is selected from water-containing salts of which the water vapor partial pressure, at a specific temperature in the range of from 30 to 100° C., corresponds to the $H_2O$ partial pressure of the saturated solution of this salt at the same temperature. As a result, the corresponding water-containing salt, also referred to herein as a "hydrate," dissolves upon reaching or exceeding this temperature in its own water of crystallization, thereby transitioning from a solid to a liquid state of matter. Preferably, the carrier materials according to the invention exhibit this behavior at a temperature in the range of from 40 to 90° C., particularly preferably between 50 and 85° C., even more preferably between 55 and 80° C.

In particular, sodium acetate trihydrate ($Na(CH_3COO).3H_2O$), Glauber's salt ($Na_2SO_4.10H_2O$), trisodium phosphate dodecahydrate ($Na_3PO_4.12\ H_2O$) and strontium chloride hexahydrate ($SrCl_2.6H_2O$) are included in the previously described water-soluble carrier materials from the group of water-containing salts.

A particularly suitable hydrate is sodium acetate trihydrate ($Na(CH_3COO).3H_2O$), since it dissolves in the particularly preferred temperature range of 55 to 80° C., specifically at approximately 58° C., in its own water of crystallization. The sodium acetate trihydrate can be used directly as such, but it is alternatively also possible to use water-free sodium acetate in combination with free water, the trihydrate then forming in situ. In such embodiments, the water is used in a substoichiometric or hyperstoichiometric amount, based on the amount necessary to convert all the sodium acetate to sodium acetate trihydrate, preferably in an amount of at least 60 wt. %, preferably at least 70 wt. %, more preferably at least 80 wt. %, most preferably 90 wt. %, 100 wt. % or more, of the amount theoretically required to convert all of the sodium acetate to sodium acetate trihydrate ($Na(CH_3COO).3H_2O$). The hyperstoichiometric use of water is particularly preferred. With respect to the compositions according to the invention, this means that when (water-free) sodium acetate is used alone or in combination with a hydrate thereof, preferably the trihydrate, water is also used, the amount of water being at least equal to the amount that would be stoichiometrically necessary to ensure that at least 60 wt. % of the total amount of sodium acetate and its hydrates, preferably at least 70 wt. %, more preferably at least 80 wt. %, even more preferably at least 90 wt. %, most preferably at least 100 wt. %, is present in the form of sodium acetate trihydrate. As already described above, it is particularly preferable for the amount of water to exceed the amount that would theoretically be necessary to convert all of the sodium acetate to the corresponding trihydrate. This means, for example, that a composition containing 50 wt. % water-free sodium acetate and no hydrate thereof contains at least 19.8 wt. % water (60% of 33 wt. %, which would theoretically be necessary to convert all of the sodium acetate to the trihydrate).

All of the embodiments described below can be explicitly combined with both of the aforementioned alternatives.

In various embodiments, the at least one carrier material is used in such an amount that the resulting melt body, i.e. the fragrance pastille, is from 30 to 95 wt. % of the carrier material, preferably from 40 to 90 wt. %, for example from 45 to 90 wt. %, based on the total weight of the melt body.

Another component of the particulate, solid composition as described herein is at least one fragrance. A fragrance is a chemical substance that stimulates the sense of smell. In order to be able to stimulate the sense of smell, it should be possible to at least partially redistribute the chemical substance in the air, i.e. the fragrance should be volatile at 25° C. at least to a small extent. If the fragrance is very volatile, the odor intensity abates quickly. At a lower volatility, however, the smell is longer-lasting, i.e. it does not disappear as quickly. In one embodiment, the fragrance therefore has a melting point in the range of from −100° C. to 100° C., preferably from −80° C. to 80° C., more preferably from −20° C. to 50° C., in particular from −30° C. to 20° C. In another embodiment, the fragrance therefore has a boiling point in the range of from 25° C. to 400° C., preferably from 50° C. to 380° C., more preferably from 75° C. to 350° C., in particular from 100° C. to 330° C.

Overall, in order to act as a fragrance, a chemical substance should not exceed a certain molecular weight since, if molecular weight is too high, the required volatility can no longer be ensured. In one embodiment, the fragrance has a molecular weight of from 40 to 700 g/mol, more preferably from 60 to 400 g/mol.

The odor of a fragrance is perceived by most people as pleasant and often corresponds to the smell of, for example, flowers, fruits, spices, bark, resin, leaves, grasses, mosses and roots. Fragrances can thus also be used to overlay unpleasant odors or even to provide a non-smelling substance with a desired odor. It is possible, for example, to use individual odorant compounds, such as synthetic products of the ester, ether, aldehyde, ketone, alcohol and hydrocarbon types, as fragrances.

Fragrance compounds of the aldehyde type are, for example, adoxal (2,6,10-trimethyl-9-undecenal), anisaldehyde (4-methoxybenzaldehyde), cymene (3-(4-isopropylphenyl)-2-methylpropanal), ethylvanillin, Florhydral (3-(3-isopropylphenyl)butanal), helional (3-(3,4-methylenedioxyphenyl)-2-methylpropanal), heliotropin, hydroxycitronellal, lauraldehyde, Lyral (3- and 4-(4-hydroxy-4-methylpentyl)-3-cyclohexene-1-carboxaldehyde), methylnonylacetaldehyde, Lilial (3-(4-tert-butylphenyl)-2-methylpropanal), phenylacetaldehyde, undecylenealdehyde, vanillin, 2,6,10-trimethyl-9-undecenal, 3-dodecene-1-al, alpha-n-amylcinnamaldehyde, Melonal (2,6-dimethyl-5-heptenal), 2,4-dimethyl-3-cyclohexene-1-carboxaldehyde (Triplal), 4-methoxybenzaldehyde, benzaldehyde, 3-(4-tert-butylphenyl)-propanal, 2-methyl-3-(para-methoxyphenyl) propanal, 2-methyl-4-(2,6,6-timethyl-2(1)-cyclohexene-1-yl)butanal, 3-phenyl-2-propenal, cis-/trans-3,7-dimethyl-2,6-octadiene-1-al, 3,7-dimethyl-6-octene-1-al, [(3,7-dimethyl-6-octenyl)oxy] acetaldehyde, 4-isopropylbenzylaldehyde, 1,2,3,4,5,6,7,8-octahydro-8,8-dimethyl-2-naphthaldehyde, 2,4-dimethyl-3-cyclohexene-1-carboxaldehyde, 2-methyl-3-(isopropylphenyl)propanal, 1-decanal, 2,6-dimethyl-5-heptenal, 4-(tricyclo[5.2.1.0(2,6)]-decylidene-8)-butanal, octahydro-4,7-methane-1H-indenecarboxaldehyde, 3-ethoxy-4-hydroxybenzaldehyde, para-ethyl-alpha, alpha-dimethylhydrocinnamaldehyde, alpha-methyl-3,4-(methylenedioxy)-hydrocinnamaldehyde, 3,4-methylenedioxybenzaldehyde, alpha-n-hexylcinnamaldehyde, m-cymene-7-carboxaldehyde, alpha-methylphenylacetaldehyde, 7-hydroxy-3,7-dimethyloctanal, undecenal, 2,4,6-trimethyl-3-cyclohexene-1-carboxaldehyde, 4-(3)(4-methyl-3-pentenyl)-3-cyclohexene carboxaldehyde, 1-dodecanal, 2,4-dimethylcyclohexene-3-carboxaldehyde, 4-(4-hydroxy-4-methylpentyl)-3-cyclohexene-1-carboxaldehyde, 7-methoxy-3,7-dimethyloctane-1-al, 2-methyl-undecanal, 2-methyldecanal, 1-nonanal, 1-octanal, 2,6,10-trimethyl-5,9-undecadienal, 2-methyl-3-(4-tert-butyl)propanal, dihydrocinnamaldehyde, 1-methyl 4-(4-methyl-3-pentenyl)-3-cyclohexene-1-carboxaldehyde, 5- or 6-methoxyhexahydro-4,7-methanindane-1- or 2-carboxaldehyde, 3,7-dimethyloctane-1-al, 1-undecanal, 10-undecene-1-al, 4-hydroxy-3-methoxybenzaldehyde, 1-methyl-3-(4-methylpentyl)-3-cyclohexenecarboxaldehyde, 7-hydroxy-3J-dimethyl-octanal, trans 4-decenal, 2,6-nonadienal, para-tolylacetaldehyde, 4-methylphenylacetaldehyde, 2-methyl-4-(2,6,6-trimethyl-1-cyclohexene-1-yl)-2-butenal, ortho-methoxycinnamaldehyde, 3,5,6-trimethyl-3-cyclohexene-carboxaldehyde, 3J-dimethyl-2-methylene-6-octenal, phenoxyacetaldehyde, 5,9-dimethyl-4,8-decadienal, peonyaldehyde (6,10-dimethyl-3-oxa-5,9-undecadiene-1-al), hexahydro-4,7-methanindane-1-carboxaldehyde, 2-methyl-octanal, alpha-methyl-4-(1-methylethyl)benzene-acetaldehyde, 6,6-dimethyl-2-norpinen-2-propionaldehyde, para-methylphenoxyacetaldehyde, 2-methyl-3-phenyl-2-propene-1-al, 3,5,5-trimethylhexanal, hexahydro-8,8-dimethyl-2-naphthaldehyde, 3-propyl-bicyclo[2.2.1]-hept-5-ene-2-carbaldehyde, 9-decenal, 3-methyl-5-phenyl-1-pentanal, methylnonylacetaldehyde, hexanal and trans-2-hexenal.

Fragrance compounds of the ketone type are, for example, methyl-beta-naphthyl ketone, musk indanone (1,2,3,5,6,7-hexahydro-1,1,2,3,3-pentamethyl-4H-inden-4-one), tonalide (6-acetyl-1,1,2,4,4,7-hexamethyltetralin), alpha-damascone, beta-damascone, delta-damascone, iso-damascone, damascenone, methyldihydrojasmonate, menthone, carvone, camphor, Koavone (3,4,5,6,6-pentamethylhept-3-en-2-one), fenchone, alpha-ionone, beta-ionone, gamma-methyl-ionone, fleuramone (2-heptylcyclopentanone), dihydrojasmone, cis-jasmone, Iso-E-Super (1-(1,2,3,4,5,6J,8-octahydro-2,3,8,8-tetramethyl-2-naphthalenyl)-ethane-1-one (and isomers)), methyl cedrenyl ketone, acetophenone, methyl acetophenone, para-methoxy acetophenone, methyl beta-naphthyl ketone, benzyl acetone, benzophenone, para-hydroxyphenyl butanone, celery ketone (3-methyl-5-propyl-2-cyclohexenone), 6-isopropyldecahydro-2-naphthone, dimethyloctenone, frescomenthe (2-butane-2-yl-cyclohexane-1-one), 4-(1-ethoxyvinyl)-3,3,5,5-tetramethylcyclohexanone, methylheptenone, 2-(2-(4-methyl)-3-cyclohexen-1-yl)propyl)cyclopentanone, 1-(p-menthene-6(2)-yl)-1-propanone, 4-(4-hydroxy-3-methoxyphenyl)-2-butanone, 2-acetyl-3,3-dimethylnorbornane, 6,7-dihydro-1,1,2,3,3-pentamethyl-4(5H)-indanone, 4-damascol, Dulcinyl(4-(1,3-benzodioxol-5-yl)butane 2-one), hexalone (1-(2,6,6-trimethyl-2-cyclohexene-1-yl)-1,6-heptadien-3-one), Isocyclemone E (2-acetonaphthone-1,2,3,4,5,6,7,8-octahydro-2,3,8,8-tetramethyl), methyl nonylketone, methylcyclocitrone, methyl lavender ketone, Orivone (4-tert-amylcyclohexanone), 4-tert-butylcyclohexanone, delphone (2-pentyl-cyclopentanone), muscone (CAS 541-91-3), neobutenone (1-(5,5-dimethyl-1-cyclohexenyl)pent-4-en-1-one), plicatone (CAS 41724-19-0), veloutone (2,2,5-trimethyl-5-pentylcyclopentane-1-one), 2,4,4,7-tetramethyl-oct-6-en-3-one and tetramerane (6,10-dimethylundecene-2-one).

Fragrance compounds of the alcohol type are, for example, 10-undecen-1-ol, 2,6-dimethylheptan-2-ol, 2-methylbutanol, 2-methylpentanol, 2-phenoxyethanol, 2-phenylpropanol, 2-tert-butycyclohexanol, 3,5,5-trimethyl-cyclohexanol, 3-hexanol, 3-methyl-5-phenyl-pentanol, 3-octanol, 3-phenyl-propanol, 4-heptenol, 4-isopropylcyclohexanol, 4-tert-butycyclohexanol, 6,8-dimethyl-2-nonanol, 6-nonen-1-ol, 9-decen-1-ol, α-methylbenzyl alcohol, α-terpineol, amyl salicylate, benzyl alcohol, benzyl salicylate, β-terpineol, butyl salicylate, citronellol, cyclohexyl salicylate, decanol, di-hydromyrcenol, dimethylbenzylcarbinol, dimethylheptanol, dimethyloctanol, ethylsalicylate, ethylvanillin, eugenol, farnesol, geraniol, heptanol, hexylsalicylate, isoborneol, isoeugenol, isopulegol, linalool, menthol, myrtenol, n-hexanol, nerol, nonanol, octanol, p-menthan-7-ol, phenylethyl alcohol, phenol, phenyl salicylate, tetrahydrogeraniol, tetrahydrolinalool, thymol, trans-2-cis-6-nonadicnol, trans-2-nonen-1-ol, trans-2-octenol, undecanol, vanillin, champiniol, hexenol and cinnamyl alcohol.

Fragrance compounds of the ester type are, for example, benzyl acetate, phenoxyethyl isobutyrate, p-tert-butylcyclohexyl acetate, linalyl acetate, dimethylbenzylcarbinyl acetate (DMBCA), phenylethyl acetate, benzyl acetate, ethylmethylphenyl glycinate, allylcyclohexyl propionate, styrallyl propionate, benzyl salicylate, cyclohexyl salicylate, floramate, melusate, and jasmacyclate.

Ethers include, for example, benzyl ethyl ether and Ambroxan. Hydrocarbons mainly include terpenes such as limonene and pinene.

Preferably, mixtures of different fragrances are used, which together produce an appealing fragrance note. Such a mixture of fragrances may also be referred to as perfume or perfume oil. Perfume oils of this kind may also contain natural fragrance mixtures, such as those obtainable from plant sources.

Fragrances of plant origin include essential oils such as angelica root oil, anise oil, arnica blossom oil, basil oil, bay oil, champaca blossom oil, citrus oil, abies alba oil, abies alba cone oil, elemi oil, eucalyptus oil, fennel oil, spruce needle oil, galbanum oil, geranium oil, ginger grass oil, guaiac wood oil, gurjun balsam oil, helichrysum oil, ho oil, ginger oil, iris oil, jasmine oil, cajeput oil, calamus oil, chamomile oil, camphor oil, cananga oil, cardamom oil, cassia oil, pine needle oil, copaiba balsam oil, coriander oil, spearmint oil, caraway oil, cumin oil, labdanum oil, lavender oil, lemon grass oil, lime blossom oil, lime oil, mandarin oil, melissa oil, mint oil, musk seed oil, myrrh oil, clove oil, neroli oil, niaouli oil, olibanum oil, orange blossom oil, orange peel oil, oregano oil, palmarosa oil, patchouli oil, balsam Peru oil, petitgrain oil, pepper oil, peppermint oil, allspice oil, pine oil, rose oil, rosemary oil, sage oil, sandalwood oil, celery oil, spike lavender oil, star anise oil, turpentine oil, thuja oil, thyme oil, verbena oil, vetiver oil, juniper berry oil, wormwood oil, wintergreen oil, ylang-ylang oil, hyssop oil, cinnamon oil, cinnamon leaf oil, citronella oil, lemon oil and cypress oil, and ambrettolide, Ambroxan, alpha-amylcinnamaldehyde, anethole, anisaldehyde, anise alcohol, anisole, anthranilic acid methyl ester, acetophenone, benzylacetone, benzaldehyde, benzoic acid ethyl ester, benzophenone, benzyl alcohol, benzyl acetate, benzyl benzoate, benzyl formate, benzyl valerianate, borneol, bornyl acetate, boisambrene forte, alpha-bromostyrene, n-decyl aldehyde, n-dodecyl aldehyde, eugenol, eugenol methyl ether, eucalyptol, farnesol, fenchone, fenchyl acetate, geranyl acetate, geranyl formate, heliotropin, heptyne carboxylic acid methyl ester, heptaldehyde, hydroquinone dimethyl ether, hydroxycinnamaldehyde, hydroxycinnamyl alcohol, indole, irone, isoeugenol, isoeugenol methyl ether, isosafrole, jasmine, camphor, carvacrol, carvone, p-cresol methyl ether, coumarin, p-methoxyacetophenone, methyl n-amyl ketone, methylanthranilic acid methyl ester, p-methylacetophenone, methylchavicol, p-methylquinoline, methyl beta-naphthyl ketone, methyl n-nonylacetaldehyde, methyl n-nonyl ketone, muscone, beta-naphthol ethyl ether, beta-naphthol methyl ether, nerol, n-nonylaldehyde, nonyl alcohol, n-octylaldehyde, p-oxy-acetophenone, pentadecanolide, beta-phenethyl alcohol, phenylacetic acid, pulegone, safrole, salicylic acid isoamyl ester, salicylic acid methyl ester, salicylic acid hexyl ester, salicylic acid cyclohexyl ester, santalol, skatole, terpineol, thyme, thymol, gamma-undecalactone, vanillin, veratraldehyde, cinnamaldehyde, cinnamyl alcohol, cinnamic acid, cinnamic acid ethyl ester, cinnamic acid benzyl ester, diphenyl oxide, limonene, linalool, linalyl acetate and propionate, melusate, menthol, menthone, methyl-n-heptenone, pinene, phenylacetaldehyde, terpinyl acetate, citral, citronellal and mixtures thereof.

In an alternative embodiment, it may be preferable for at least some of the fragrance to be used as a fragrance precursor or in encapsulated form (fragrance capsules), in particular in microcapsules. However, it is also possible to use the entire fragrance in encapsulated or non-encapsulated form. The microcapsules may be water-soluble and/or water-insoluble microcapsules. For example, melamine-urea-formaldehyde microcapsules, melamine-formaldehyde microcapsules, urea-formaldehyde microcapsules or starch microcapsules may be used. "Fragrance precursor" refers to compounds that release the actual fragrance only after chemical conversion/cleavage, typically by exposure to light or other environmental conditions such as pH, temperature, etc. Such compounds are often also referred to as fragrance storage substances or "pro-fragrances."

Irrespective of the form in which they are used, the amount of fragrance in the melt bodies is preferably between 1 and 20 wt. %, preferably 1 to 15 wt. % and in particular from 3 to 12 wt. %, based on the total weight of the composition. It is a feature of the present invention that the fragrance, or the fragrance particles, is homogeneously distributed in the carrier material and in particular is not present as a coating of a core of carrier material.

In various embodiments, the composition according to the invention does not contain polyethylene glycol (PEG) that is solid at room temperature (25° C.) in the form of a coating, more preferably the composition does not contain any PEG that is solid at room temperature (25° C.), i.e., the content of PEG that is solid at room temperature (25° C.) is less than 1 wt. % based on the composition.

In further embodiments, the composition according to the invention does not contain any polyethylene glycol (PEG) at all in the form of a coating, more preferably the composition does not contain any PEG at all, i.e., the content of PEG that is solid or liquid at room temperature is less than 1 wt. % based on the composition.

The compositions contain a rheology modifier as an essential constituent. Inorganic and organic substances having corresponding properties influencing the rheology of the molten composition can be used as rheology modifiers. These substances may be solid (at 20° C. and 1 bar) or liquid ingredients, the use of solid rheology modifiers being preferred.

The group of inorganic rheology modifiers includes, for example, pyrogenic silicic acid, which is particularly preferred due to its advantageous technical effect.

This is preferably contained in the composition in an amount of 0.1 to 20 wt. %, preferably 0.5 to 3 wt. %, more preferably 1 to 2.5 wt. %, even more preferably 1.2 to 2.0 wt. %.

The silicic acids used are preferably highly dispersed silicic acids, for example those having BET surface areas of more than 50 $m^2/g$, preferably more than 100 $m^2/g$, more preferably 150 to 250 $m^2/g$, in particular 175 to 225 $m^2/g$.

Suitable silicic acids are commercially available from Evonik under the tradenames Aerosil® and Sipernat®. Aerosil® 200 is particularly preferred.

In the case of the organic rheology modifiers, the use of cellulose, in particular microfibrillated cellulose (MFC, nanocellulose), is preferred. Particularly suitable as cellulose are MFCs, such as Exilva (Borregaard) or Avicel® (FMC), which are commercially available. In addition, or as an alternative to the above-mentioned substances, further solids or fillers which differ from the above-mentioned substances may be present.

Microfibrillated cellulose (MFC) is preferably used in amounts of from 0.1 to 5 wt. %, particularly preferably 0.1 to 3 wt. %, more preferably 0.3 to 2 wt. %, in each case based on the total weight of the composition.

Emulsifying substances such as fatty alcohols, for example stearyl alcohol, fatty alcohol alkoxylates, such as fatty alcohol ethoxylates used as nonionic surfactants, fatty alcohol sulfates, fatty alcohol ether sulfates and alkylbenzenesulfonates are also suitable as ingredients, in particular those which are also used as anionic surfactants. Suitable fatty alcohol ethoxylates are in particular the C10-22 fatty alcohol ethoxylates with up to 50 EO, very particularly preferably the C12-18 alkyl ethers with 5-8, preferably 7, EO, or the C16-18 alkyl ethers with up to 30 EO. Suitable fatty alcohol ether sulfates are the sulfates of the above-mentioned fatty alcohol ethers, suitable fatty alcohol sulfates, in particular the C10-18 fatty alcohol sulfates, very particularly the C12-16 fatty alcohol sulfates. The linear C10-13 alkylbenzene sulfonates in particular are suitable as alkylbenzene sulfonates. In summary, emulsifiers from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines or combinations thereof are preferred.

The composition may contain further solids or fillers (f) other than constituents (a) to (f). The proportion by weight of these solids or fillers in the total weight of the composition is for example up to 25 wt. %, preferably up to 20 wt. %, more preferably up to 18 wt. %, in particular up to 15 wt. %, based on the total weight of composition.

The composition according to the claims, characterized in that the components (c), (d), (e), (f) and (g) are jointly contained therein in amounts of from 0 to 25 wt. %, preferably 1 to 20 wt. %, more preferably 2 to 18 wt. %, in particular 3 to 15 wt. %, based on the total weight of the composition.

The composition may be dyed using suitable dyes in order to improve its appearance. Preferred dyes, which can be selected by a person skilled in the art without any difficulty at all, should be highly stable in storage, unaffected by the other ingredients of the washing or cleaning agent, insensitive to light and should not exhibit pronounced substantivity with respect to textile fibers in order to avoid dyeing said fibers. Such dyes are known in the prior art and are typically used in concentrations of from 0.001 to 0.5 wt. %, preferably 0.01 to 0.3 wt. %.

As described above, the composition may potentially also contain free water. The term "free water" as used herein refers to water which is not bound as water of crystallization in any of the salts contained in the composition.

A composition as described herein may be used for example in the wash cycle of a laundry cleaning process and thus may transport the perfume to the laundry right at the beginning of the washing process. Furthermore, the composition according to the invention is easier and better to handle than liquid compositions since, during subsequent storage of the bottle, no drops are left on the edge of the bottle that run down to the edges on the ground or result in unpleasant deposits in the region of the bottle cap. The same applies to the case in which, during metering, some of the composition is accidentally spilled. The spilled amount can also be removed more easily and cleanly. A method for the treatment of textiles, in the course of which a composition according to the invention is metered into the wash liquor of a textile washing machine, is a further subject of this application.

The composition may optionally contain other conventional ingredients, for example those which improve the performance and/or aesthetic properties.

Example formulations of suitable compositions include the following ingredients:

1 to 15 wt. %, in particular 2 to 8 wt. %, perfume oil and/or fragrance capsules 0.00 to <1 wt. % dye(s)

1.0 to 2.5, in particular 1.2 to 2.0 wt. %, pyrogenic silicic acid (BET 175-225) or 0.1 to 3.0, in particular 0.1 to 2 wt. %, microfibrillated cellulose up to 100 wt. % carrier material, as defined herein, in particular sodium acetate trihydrate.

The composition of some preferred compositions can be found in the following tables (amounts given in wt. % based on the total weight of the agent, unless otherwise indicated).

| | Formula 1 | Formula 2 | Formula 3 | Formula 4 | Formula 5 |
|---|---|---|---|---|---|
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |
| Rheology modifier | 0.1 to 25 | 0.1 to 20 | 0.1 to 18 | 0.1 to 15 | 0.1 to 10 |
| Misc. | up to 100 | up to 100 | up to 100 | up to 100 | up to 100 |

| | Formula 6 | Formula 7 | Formula 8 | Formula 9 | Formula 10 |
|---|---|---|---|---|---|
| Sodium acetate trihydrate | 20 to 95 | 30 to 95 | 30 to 95 | 40 to 90 | 45 to 90 |
| Perfume oil | 0.1 to 20 | 0.1 to 20 | 1.0 to 15 | 1.0 to 15 | 3.0 to 12 |
| Rheology modifier | 0.1 to 25 | 0.1 to 20 | 0.1 to 18 | 0.1 to 15 | 0.1 to 10 |
| Misc. | up to 100 | up to 100 | up to 100 | up to 100 | up to 100 |

| | Formula 11 | Formula 12 | Formula 13 | Formula 14 | Formula 15 |
|---|---|---|---|---|---|
| Sodium acetate trihydrate | 20 to 95 | 30 to 95 | 30 to 95 | 40 to 90 | 45 to 90 |
| Fragrance capsules | 0.1 to 20 | 0.1 to 20 | 1.0 to 15 | 1.0 to 15 | 3.0 to 12 |
| Rheology modifier | 0.1 to 25 | 0.1 to 20 | 0.1 to 18 | 0.1 to 15 | 0.1 to 10 |
| Misc. | up to 100 | up to 100 | up to 100 | up to 100 | up to 100 |

| | Formula 16 | Formula 17 | Formula 18 | Formula 19 | Formula 20 |
|---|---|---|---|---|---|
| Sodium acetate trihydrate | 20 to 95 | 30 to 95 | 30 to 95 | 40 to 90 | 45 to 90 |
| Perfume oil and fragrance capsules | 0.1 to 20 | 0.1 to 20 | 1.0 to 15 | 1.0 to 15 | 3.0 to 12 |
| Rheology modifier | 0.1 to 25 | 0.1 to 20 | 0.1 to 18 | 0.1 to 15 | 0.1 to 10 |
| Misc. | up to 100 | up to 100 | up to 100 | up to 100 | up to 100 |

| | Formula 21 | Formula 22 | Formula 23 | Formula 24 | Formula 25 |
|---|---|---|---|---|---|
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |
| Pyrogenic silicic acid | 1.0 to 2.5 | 1.0 to 2.5 | 1.0 to 2.5 | 1.2 to 2.0 | 1.2 to 2.0 |
| Misc. | up to 100 | up to 100 | up to 100 | up to 100 | up to 100 |

| | Formula 26 | Formula 27 | Formula 28 | Formula 29 | Formula 30 |
|---|---|---|---|---|---|
| Sodium acetate trihydrate | 20 to 95 | 30 to 95 | 30 to 95 | 40 to 90 | 45 to 90 |
| Perfume oil | 0.1 to 20 | 0.1 to 20 | 1.0 to 15 | 1.0 to 15 | 3.0 to 12 |
| Pyrogenic silicic acid | 1.0 to 2.5 | 1.0 to 2.5 | 1.0 to 2.5 | 1.2 to 2.0 | 1.2 to 2.0 |
| Misc. | up to 100 | up to 100 | up to 100 | up to 100 | up to 100 |

| | Formula 31 | Formula 32 | Formula 33 | Formula 34 | Formula 35 |
|---|---|---|---|---|---|
| Sodium acetate trihydrate | 20 to 95 | 30 to 95 | 30 to 95 | 40 to 90 | 45 to 90 |
| Fragrance capsules | 0.1 to 20 | 0.1 to 20 | 1.0 to 15 | 1.0 to 15 | 3.0 to 12 |
| Pyrogenic silicic acid | 1.0 to 2.5 | 1.0 to 2.5 | 1.0 to 2.5 | 1.2 to 2.0 | 1.2 to 2.0 |
| Misc. | up to 100 | up to 100 | up to 100 | up to 100 | up to 100 |

| | Formula 36 | Formula 37 | Formula 38 | Formula 39 | Formula 40 |
|---|---|---|---|---|---|
| Sodium acetate trihydrate | 20 to 95 | 30 to 95 | 30 to 95 | 40 to 90 | 45 to 90 |
| Perfume oil and fragrance capsules | 0.1 to 20 | 0.1 to 20 | 1.0 to 15 | 1.0 to 15 | 3.0 to 12 |
| Pyrogenic silicic acid | 1.0 to 2.5 | 1.0 to 2.5 | 1.0 to 2.5 | 1.2 to 2.0 | 1.2 to 2.0 |
| Misc. | up to 100 | up to 100 | up to 100 | up to 100 | up to 100 |

| | Formula 41 | Formula 42 | Formula 43 | Formula 44 | Formula 45 |
|---|---|---|---|---|---|
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |
| (Microfibrillated) cellulose | 0.1 to 5.0 | 0.1 to 5.0 | 0.1 to 3.0 | 0.1 to 3.0 | 0.3 to 2.0 |
| Misc. | up to 100 | up to 100 | up to 100 | up to 100 | up to 100 |

| | Formula 46 | Formula 47 | Formula 48 | Formula 49 | Formula 50 |
|---|---|---|---|---|---|
| Sodium acetate trihydrate | 20 to 95 | 30 to 95 | 30 to 95 | 40 to 90 | 45 to 90 |
| Perfume oil | 0.1 to 20 | 0.1 to 20 | 1.0 to 15 | 1.0 to 15 | 3.0 to 12 |
| (Microfibrillated) cellulose | 0.1 to 5.0 | 0.1 to 5.0 | 0.1 to 3.0 | 0.1 to 3.0 | 0.3 to 2.0 |
| Misc. | up to 100 | up to 100 | up to 100 | up to 100 | up to 100 |

| | Formula 51 | Formula 52 | Formula 53 | Formula 54 | Formula 55 |
|---|---|---|---|---|---|
| Sodium acetate trihydrate | 20 to 95 | 30 to 95 | 30 to 95 | 40 to 90 | 45 to 90 |
| Fragrance capsules | 0.1 to 20 | 0.1 to 20 | 1.0 to 15 | 1.0 to 15 | 3.0 to 12 |
| (Microfibrillated) cellulose | 0.1 to 5.0 | 0.1 to 5.0 | 0.1 to 3.0 | 0.1 to 3.0 | 0.3 to 2.0 |
| Misc. | up to 100 | up to 100 | up to 100 | up to 100 | up to 100 |

| | Formula 56 | Formula 57 | Formula 58 | Formula 59 | Formula 60 |
|---|---|---|---|---|---|
| Sodium acetate trihydrate | 20 to 95 | 30 to 95 | 30 to 95 | 40 to 90 | 45 to 90 |
| Perfume oil and fragrance capsules | 0.1 to 20 | 0.1 to 20 | 1.0 to 15 | 1.0 to 15 | 3.0 to 12 |
| (Microfibrillated) cellulose | 0.1 to 5.0 | 0.1 to 5.0 | 0.1 to 3.0 | 0.1 to 3.0 | 0.3 to 2.0 |
| Misc. | up to 100 | up to 100 | up to 100 | up to 100 | up to 100 |

| | Formula 61 | Formula 62 | Formula 63 | Formula 64 | Formula 65 |
|---|---|---|---|---|---|
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |
| Fatty alcohol ethoxylate having 5 to 50 EO | 0.1 to 10 | 0.1 to 5.0 | 0.2 to 5.0 | 0.2 to 3.0 | 0.5 to 2.0 |
| Rheology modifier | 0.1 to 25 | 0.1 to 20 | 0.1 to 18 | 0.1 to 15 | 0.1 to 10 |
| Misc. | up to 100 | up to 100 | up to 100 | up to 100 | up to 100 |

| | Formula 66 | Formula 67 | Formula 68 | Formula 69 | Formula 70 |
|---|---|---|---|---|---|
| Sodium acetate trihydrate | 20 to 95 | 30 to 95 | 30 to 95 | 40 to 90 | 45 to 90 |
| Perfume oil | 0.1 to 20 | 0.1 to 20 | 1.0 to 15 | 1.0 to 15 | 3.0 to 12 |
| Fatty alcohol ethoxylate having 5 to 50 EO | 0.1 to 10 | 0.1 to 5.0 | 0.2 to 5.0 | 0.2 to 3.0 | 0.5 to 2.0 |
| Rheology modifier | 0.1 to 25 | 0.1 to 20 | 0.1 to 18 | 0.1 to 15 | 0.1 to 10 |
| Misc. | up to 100 | up to 100 | up to 100 | up to 100 | up to 100 |

| | Formula 71 | Formula 72 | Formula 73 | Formula 74 | Formula 75 |
|---|---|---|---|---|---|
| Sodium acetate trihydrate | 20 to 95 | 30 to 95 | 30 to 95 | 40 to 90 | 45 to 90 |
| Fragrance capsules | 0.1 to 20 | 0.1 to 20 | 1.0 to 15 | 1.0 to 15 | 3.0 to 12 |
| Fatty alcohol ethoxylate having 5 to 50 EO | 0.1 to 10 | 0.1 to 5.0 | 0.2 to 5.0 | 0.2 to 3.0 | 0.5 to 2.0 |
| Rheology modifier | 0.1 to 25 | 0.1 to 20 | 0.1 to 18 | 0.1 to 15 | 0.1 to 10 |
| Misc. | up to 100 | up to 100 | up to 100 | up to 100 | up to 100 |

| | Formula 76 | Formula 77 | Formula 78 | Formula 79 | Formula 80 |
|---|---|---|---|---|---|
| Sodium acetate trihydrate | 20 to 95 | 30 to 95 | 30 to 95 | 40 to 90 | 45 to 90 |
| Perfume oil and fragrance capsules | 0.1 to 20 | 0.1 to 20 | 1.0 to 15 | 1.0 to 15 | 3.0 to 12 |
| Fatty alcohol ethoxylate having 5 to 50 EO | 0.1 to 10 | 0.1 to 5.0 | 0.2 to 5.0 | 0.2 to 3.0 | 0.5 to 2.0 |
| Rheology modifier | 0.1 to 25 | 0.1 to 20 | 0.1 to 18 | 0.1 to 15 | 0.1 to 10 |
| Misc. | up to 100 | up to 100 | up to 100 | up to 100 | up to 100 |

| | Formula 81 | Formula 82 | Formula 83 | Formula 84 | Formula 85 |
|---|---|---|---|---|---|
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |
| Pyrogenic silicic acid | 1.0 to 2.5 | 1.0 to 2.5 | 1.0 to 2.5 | 1.2 to 2.0 | 1.2 to 2.0 |
| (Microfibrillated) cellulose | 0.1 to 5.0 | 0.1 to 5.0 | 0.1 to 3.0 | 0.1 to 3.0 | 0.3 to 2.0 |
| Misc. | up to 100 | up to 100 | up to 100 | up to 100 | up to 100 |

| | Formula 86 | Formula 87 | Formula 88 | Formula 89 | Formula 90 |
|---|---|---|---|---|---|
| Sodium acetate trihydrate | 20 to 95 | 30 to 95 | 30 to 95 | 40 to 90 | 45 to 90 |
| Perfume oil | 0.1 to 20 | 0.1 to 20 | 1.0 to 15 | 1.0 to 15 | 3.0 to 12 |
| Pyrogenic silicic acid | 1.0 to 2.5 | 1.0 to 2.5 | 1.0 to 2.5 | 1.2 to 2.0 | 1.2 to 2.0 |
| (Microfibrillated) cellulose | 0.1 to 5.0 | 0.1 to 5.0 | 0.1 to 3.0 | 0.1 to 3.0 | 0.3 to 2.0 |
| Misc. | up to 100 | up to 100 | up to 100 | up to 100 | up to 100 |

| | Formula 91 | Formula 92 | Formula 93 | Formula 94 | Formula 95 |
|---|---|---|---|---|---|
| Sodium acetate trihydrate | 20 to 95 | 30 to 95 | 30 to 95 | 40 to 90 | 45 to 90 |
| Fragrance capsules | 0.1 to 20 | 0.1 to 20 | 1.0 to 15 | 1.0 to 15 | 3.0 to 12 |
| Pyrogenic silicic acid | 1.0 to 2.5 | 1.0 to 2.5 | 1.0 to 2.5 | 1.2 to 2.0 | 1.2 to 2.0 |
| (Microfibrillated) cellulose | 0.1 to 5.0 | 0.1 to 5.0 | 0.1 to 3.0 | 0.1 to 3.0 | 0.3 to 2.0 |
| Misc. | up to 100 | up to 100 | up to 100 | up to 100 | up to 100 |

| | Formula 96 | Formula 97 | Formula 98 | Formula 99 | Formula 100 |
|---|---|---|---|---|---|
| Sodium acetate trihydrate | 20 to 95 | 30 to 95 | 30 to 95 | 40 to 90 | 45 to 90 |
| Perfume oil and fragrance capsules | 0.1 to 20 | 0.1 to 20 | 1.0 to 15 | 1.0 to 15 | 3.0 to 12 |
| Pyrogenic silicic acid | 1.0 to 2.5 | 1.0 to 2.5 | 1.0 to 2.5 | 1.2 to 2.0 | 1.2 to 2.0 |
| (Microfibrillated) cellulose | 0.1 to 5.0 | 0.1 to 5.0 | 0.1 to 3.0 | 0.1 to 3.0 | 0.3 to 2.0 |
| Misc. | up to 100 | up to 100 | up to 100 | up to 100 | up to 100 |

| | Formula 101 | Formula 102 | Formula 103 | Formula 104 | Formula 105 |
|---|---|---|---|---|---|
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |
| Pyrogenic silicic acid | 1.0 to 2.5 | 1.0 to 2.5 | 1.0 to 2.5 | 1.2 to 2.0 | 1.2 to 2.0 |

-continued

| | Formula 101 | Formula 102 | Formula 103 | Formula 104 | Formula 105 |
|---|---|---|---|---|---|
| (Microfibrillated) cellulose | 0.1 to 5.0 | 0.1 to 5.0 | 0.1 to 3.0 | 0.1 to 3.0 | 0.3 to 2.0 |
| Fatty alcohol ethoxylate having 5 to 50 EO | 0.1 to 10 | 0.1 to 5.0 | 0.2 to 5.0 | 0.2 to 3.0 | 0.5 to 2.0 |
| Misc. | up to 100 | up to 100 | up to 100 | up to 100 | up to 100 |

| | Formula 106 | Formula 107 | Formula 108 | Formula 109 | Formula 110 |
|---|---|---|---|---|---|
| Sodium acetate trihydrate | 20 to 95 | 30 to 95 | 30 to 95 | 40 to 90 | 45 to 90 |
| Perfume oil | 0.1 to 20 | 0.1 to 20 | 1.0 to 15 | 1.0 to 15 | 3.0 to 12 |
| Pyrogenic silicic acid | 1.0 to 2.5 | 1.0 to 2.5 | 1.0 to 2.5 | 1.2 to 2.0 | 1.2 to 2.0 |
| (Microfibrillated) | 0.1 to 5.0 | 0.1 to 5.0 | 0.1 to 3.0 | 0.1 to 3.0 | 0.3 to 2.0 |
| Fatty alcohol ethoxylate having 5 to 50 EO | 0.1 to 10 | 0.1 to 5.0 | 0.2 to 5.0 | 0.2 to 3.0 | 0.5 to 2.0 |
| Misc. | up to 100 | up to 100 | up to 100 | up to 100 | up to 100 |

| | Formula 111 | Formula 112 | Formula 113 | Formula 114 | Formula 115 |
|---|---|---|---|---|---|
| Sodium acetate trihydrate | 20 to 95 | 30 to 95 | 30 to 95 | 40 to 90 | 45 to 90 |
| Fragrance capsules | 0.1 to 20 | 0.1 to 20 | 1.0 to 15 | 1.0 to 15 | 3.0 to 12 |
| Pyrogenic silicic acid | 1.0 to 2.5 | 1.0 to 2.5 | 1.0 to 2.5 | 1.2 to 2.0 | 1.2 to 2.0 |
| (Microfibrillated) | 0.1 to 5.0 | 0.1 to 5.0 | 0.1 to 3.0 | 0.1 to 3.0 | 0.3 to 2.0 |
| Fatty alcohol ethoxylate having 5 to 50 EO | 0.1 to 10 | 0.1 to 5.0 | 0.2 to 5.0 | 0.2 to 3.0 | 0.5 to 2.0 |
| Misc. | up to 100 | up to 100 | up to 100 | up to 100 | up to 100 |

| | Formula 116 | Formula 117 | Formula 118 | Formula 119 | Formula 120 |
|---|---|---|---|---|---|
| Sodium acetate trihydrate | 20 to 95 | 30 to 95 | 30 to 95 | 40 to 90 | 45 to 90 |
| Perfume oil and fragrance capsules | 0.1 to 20 | 0.1 to 20 | 1.0 to 15 | 1.0 to 15 | 3.0 to 12 |
| Pyrogenic silicic acid | 1.0 to 2.5 | 1.0 to 2.5 | 1.0 to 2.5 | 1.2 to 2.0 | 1.2 to 2.0 |
| (Microfibrillated) cellulose | 0.1 to 5.0 | 0.1 to 5.0 | 0.1 to 3.0 | 0.1 to 3.0 | 0.3 to 2.0 |
| Fatty alcohol ethoxylate having 5 to 50 EO | 0.1 to 10 | 0.1 to 5.0 | 0.2 to 5.0 | 0.2 to 3.0 | 0.5 to 2.0 |
| Misc. | up to 100 | up to 100 | up to 100 | up to 100 | up to 100 |

The composition according to the present invention is a solid, particulate composition. The individual particles of the composition can be referred to as melting bodies that are solid at room temperature and temperatures up to 30° C., preferably up to 40° C.

In various embodiments of the invention, the melt bodies according to the invention are coated. Suitable coating agents are, for example, tablet coatings known from pharmaceutical literature. However, the pastilles can also be waxed, i.e. coated with a wax, or, to protect against caking (agglomeration), be powder-coated with a powdered material, for example a release agent. It is preferred for the coating not to consist of PEG or to comprise it in any significant amount (>10 wt. %, based on the coating).

A method for preparing melt bodies of this kind may include the following steps:

(a) producing, preferably continuously producing and conveying, a melt comprising the at least one water-soluble carrier material and the at least one rheology modifier
(b) optionally metering in additional optional ingredients;
(c) metering, preferably continuously metering, the at least one fragrance and optionally a dye into the melt;
(d) mixing the melt and the at least one fragrance; and
(e) cooling and optionally reshaping the mixture to obtain perfume-containing melt bodies.

The melt bodies prepared in this way may have any desired shape. Shaping takes place in particular in step (d) of the described method. Solid, particulate shapes, such as substantially spherical, figurative, scaled, cuboid, cylindrical, conical, spherical-cap-shaped, lenticular, hemispherical, disk-shaped or acicular particles, are preferred. For example, the particles may have a gummy bear-like, figurative design. On account of their packaging properties and their performance profile, hemispherical particles are particularly preferred.

It is furthermore preferred for the composition to consist of at least 20 wt. %, preferably at least 40 wt. %, more preferably at least 60 wt. % and particularly preferably at least 80 wt. %, particles which have a spatial extension of between 0.5 and 10 mm, in particular 0.8 to 7 mm and particularly preferably 1 to 3 mm, in any spatial direction. On account of their appearance, such particles are characterized by increased customer acceptance.

Preferably, at least 20 wt. %, preferably at least 40 wt. %, more preferably at least 60 wt. % and particularly preferably at least 80 wt. %, of the composition consists of particles in which the ratio of the longest particle diameter determined in any spatial direction to the shortest diameter determined in any spatial direction is between 3:1 and 1:1, preferably between 2.5:1 and 1.2:1 and in particular between 2.2:1 and 1.4:1.

Finally, it has proven to be advantageous for the dosage and the fragrance effect if the composition consists of at least 20 wt. %, preferably at least 40 wt. %, more preferably at least 60 wt. % and particularly preferably at least 80 wt. %, particles which have a particle weight of between 2 and 150 mg, preferably between 4 and 60 mg and in particular between 5 and 10 mg.

The particularly preferred melt bodies described above, in particular those having a particle weight of between 2 and 150 mg, a spatial extent of between 0.5 and 10 mm and a hemispherical three-dimensional shape, can advantageously be prepared by means of pastillation.

In the context of such a preferred method variant, the melt of the water-soluble carrier material is pressed into a heated inner body and a drum-shaped outer tube that is provided with numerous holes and rotates concentrically around the fixed inner body and in the process deposits product drops over the entire width of a circulating cooling belt, preferably a steel strip.

The viscosity (Texas Instruments AR-G2 rheometer; plate/plate, 4 cm diameter, 1100 μm column, shear rate 10/1 sec) of the mixture as it leaves the rotating, perforated outer drum is preferably between 1,000 and 10,000 mPas.

The droplets of the mixture that are discharged from the drop former are solidified on the steel strip so as to form solid melt bodies. The period of time between the dropping of the mixture onto the steel strip and the complete solidification of the mixture is preferably between 5 and 60 seconds, particularly preferably between 10 and 50 seconds and in particular between 20 and 40 seconds.

The solidification of the mixture is preferably supported and accelerated by cooling. The cooling of the drops applied to the steel strip can be direct or indirect. As direct cooling, for example, cooling by means of cold air can be used. However, indirect cooling of the drops by cooling the underside of the steel strip by means of cold water is preferred.

A preferred method for the preparation of hemispherical melt bodies, in particular for preparing the melt bodies described in formulas 1 to 120 with respect to their composition, comprises the following steps:

(a) producing, preferably continuously producing and conveying, a melt comprising the at least one water-soluble carrier material and the buffer system;
(b) optionally metering in additional optional ingredients;
(c) metering, preferably continuously metering, the at least one perfume, the at least one rheology modifier and optionally a dye into the melt;
(d) mixing the melt and the at least one fragrance;
(e) applying drops of the resulting mixture to a cooling belt by means of a drop former having a rotating, perforated outer drum; and
(f) solidifying the drops of the mixture on the steel strip to form solid hemispherical melt bodies.

A very particularly preferred method variant, in particular for the preparation of the melt bodies described in formulas 1 to 100 with respect to their composition, comprises the steps of:

(a) producing, preferably continuously producing and conveying, a melt comprising the at least one water-soluble carrier material sodium acetate trihydrate ($Na(CH_3COO).3H_2O$) and the buffer system;
(b) optionally metering in additional optional ingredients;
(c) metering, preferably continuously metering, the at least one perfume, the at least one rheology modifier and optionally a dye into the melt;
(d) mixing the melt and the at least one fragrance;
(e) applying drops of the resulting mixture to a cooling belt by means of a drop former having a rotating, perforated outer drum; and
(f) solidifying the drops of the mixture on the steel strip to form solid hemispherical melt bodies.

In various embodiments, producing a melt, i.e. the melting, takes place in step (a) of the methods described herein by heating to a temperature that is no more than 20° C. above the temperature of the carrier material, at which temperature the water vapor partial pressure of the hydrate corresponds to the $H_2O$ partial pressure of the saturated solution of this salt. As already described above, the carrier material can already be used as a hydrate or the hydrate is obtained by combining the water-free salt and water in a substoichiometric, stoichiometric or hyperstoichiometric amount, preferably a stoichiometric or hyperstoichiometric amount, based on the amount required to transfer the entire salt into the desired hydrate, generated in situ before step (a) or in step (a).

Melting can be carried out using any conventional methods and devices known to a person skilled in the art. The melt containing the at least one carrier material is produced, for example, continuously, by the at least one carrier material, the rheology modifier and optionally further optional constituents of the melt body, such as pyrogenic silicic acid, cellulose, fatty alcohols, fatty alcohol alkoxylates, fatty alcohol sulfates, fatty alcohol ether sulfates, alkylbenzene sulfonates or a solid or filler, alone or in combinations, being continuously supplied to a corresponding device in which it is heated and the melt thus produced further conveyed, for example pumped.

However, the melt can also be prepared separately, for example in a batch process. According to the invention, embodiments are also included in which the constituents of the melt are mixed together at any time prior to carrying out the method according to the invention and the mixture is stored in molten or cooled solid form until the method is carried out. The melt thus produced can be used as a master batch to which, in the following step, depending on the needs, different fragrances and optionally also other ingredients, such as dyes, are then added.

In a next step, the at least one fragrance is then metered continuously into the melt. For this purpose, the at least one fragrance is preferably used in liquid form, for example as a perfume oil, as a solution in a suitable solvent or as a suspension of perfume capsules in a, typically water-containing, solvent. "Liquid" as used in this context means liquid under the conditions of use, preferably liquid at 20° C. In addition to the fragrance, a dye can also be metered in this step. For example, the dye may be indicative of the type of fragrance, i.e., for a particular fragrance/fragrance mixture a specific dye or dye mixture is used to make the resulting pastilles immediately visually distinguishable.

During preparation, the flow can optionally be controlled by means of flow rate measurement of the individual metered flows, i.e. the melt, the fragrance flow and optionally further ingredient flows. This also allows, for example, for the proportions of the individual constituents to be adjusted. The ingredients, in addition to the carrier material and the fragrances, can be produced directly together with the carrier material as a melt, be metered in together with the fragrances or be metered separately into the melt. In the latter alternative, the metering-in may take place before or after the metering-in of the fragrances.

In some embodiments, the method according to the invention is characterized in that at least one rheology modifier and optionally at least one further constituent of the melting body, such as fatty alcohols, fatty alcohol alkoxylates, fatty alcohol sulfates, fatty alcohol ether sulfates, alkylbenzene sulfonates or a solid or filler, alone or in combinations with the melt produced and conveyed in step (a), are metered in and/or already contained in the melt that is produced and conveyed in step (a).

The mixing of the combined metered flows can then be carried out, in each case directly after metering in or downstream after metering in several or all of the ingredients, using suitable mixers such as conventional static or dynamic mixing units.

After mixing, the melt containing the fragrances, the rheology modifier and optional solids and optionally other ingredients, as well as the carrier polymer, is cooled and optionally supplied to the shaping step in which the melt solidifies and obtains its final shape. Suitable methods for shaping are known to a person skilled in the art. Conventional shapes have already been described above.

The invention also relates to the melt bodies obtained by means of the methods described herein and to the use thereof as textile care agents, preferably fragrancing agents and/or softeners, for fragrancing and/or conditioning textile fabrics. The melt bodies may be a textile treatment agent such as a fabric softener or part of an agent of this kind.

Furthermore, the invention relates to a washing or cleaning agent comprising the melt bodies prepared according to the invention.

By introducing the perfume-containing melt bodies prepared according to the invention into a washing or cleaning agent, the consumer is provided with a textile care washing or cleaning agent (a "2-in-1" washing or cleaning agent) and does not need to meter two agents or require a separate rinse cycle. Since the compositions prepared according to the invention are perfumed, the washing or cleaning agent does not need to be perfumed as well. Not only does this result in lower costs, it is also advantageous for consumers with sensitive skin and/or allergies.

The melt body compositions described herein are particularly suitable for fragrancing textile fabrics and are, for this purpose, together with a conventional washing or cleaning agent, brought into contact with the textile fabrics in the (main) wash cycle of a conventional washing and cleaning process.

If the melt body composition according to the invention is part of a washing or cleaning agent, a solid washing or cleaning agent may preferably be mixed with 1 to 20 wt. %, in particular 5 to 15 wt. %, of the composition according to the invention.

The preferred embodiments described in connection with the methods according to the invention can likewise be transferred to the melt bodies as such, to the washing and cleaning agents containing said bodies and to the uses described herein, and vice versa.

In summary, the present invention provides, inter alia:

1. A solid, particulate composition comprising
   (a) 20 to 95 wt. %, based on the total weight of the composition, of at least one water-soluble carrier material selected from water-containing salts of which the water vapor partial pressure corresponds, at a specific temperature in the range of from 30 to 100° C., to the $H_2O$ partial pressure of the saturated solution of said salt;
   (b) 0.1 to 20 wt. % of at least one fragrance,
   (c) 0.1 to 25 wt. %, based on the total weight of the composition, of at least one, preferably solid, rheology modifier of such a type and in such an amount that a melt obtained by heating the composition to 70° C. has a yield point above 1 Pa, preferably above 5 Pa and in particular above 10 Pa;
   (d) optionally up to 25 wt. %, based on the total weight of the composition, of an emulsifier, preferably an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines, or combinations thereof;
   (e) optionally up to 25 wt. %, based on the total weight of the composition, of at least one solid or filler that is different from (c) and (d); and
   (f) optionally at least one dye.
2. A solid, particulate composition comprising
   (a) 20 to 95 wt. %, based on the total weight of the composition, of at least one water-soluble carrier material selected from water-containing salts of which the water vapor partial pressure corresponds, at a specific temperature in the range of from 30 to 100° C., to the $H_2O$ partial pressure of the saturated solution of said salt;
   (b) 0.1 to 20 wt. % of at least one fragrance,
   (c) 0.1 to 25 wt. %, preferably 0.5 to 3 wt. %, based on the total weight of the composition,
      of an inorganic rheology modifier, preferably an inorganic rheology modifier from the group of pyrogenic silicic acids and/or
      of an organic rheology modifier, preferably an organic rheology modifier from the group of celluloses, preferably microfibrillated celluloses;
   (d) optionally up to 25 wt. %, based on the total weight of the composition, of an emulsifier, preferably an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines, or combinations thereof;
   (e) optionally up to 25 wt. %, based on the total weight of the composition, of at least one solid or filler that is different from (c) and (d); and
   (f) optionally at least one dye.
3. The composition according to one of points 1 or 2, characterized in that the water-soluble carrier material is selected from water-containing salts of which the water vapor partial pressure corresponds, at a temperature in the range of from 40 to 90° C., preferably from 50 to 85° C., more preferably from 55 to 80° C., to the $H_2O$ partial pressure of the saturated solution of said salt, preferably sodium acetate trihydrate ($Na(CH_3COO).3H_2O$).
4. The composition according to one of points 1 to 3, characterized in that the water-soluble carrier material is contained in the composition in an amount of from 30 to 95 wt. %, preferably from 40 to 90 wt. %, in particular from 45 to 90 wt. %, based on the total weight of said composition.
5. A solid, particulate composition comprising
   (a) 12 to 57 wt. %, based on the total weight of the composition, sodium acetate;
   (b) 0.1 to 10 wt. % of at least one fragrance;
   (c) 0.1 to 25 wt. %, based on the total weight of the composition, of at least one, preferably solid, rheology modifier of such a type and in such an amount that a melt obtained by heating the composition to 70° C. has a yield point above 1 Pa, preferably above 5 Pa and in particular above 10 Pa;

(d) optionally up to 25 wt. %, based on the total weight of the composition, of an emulsifier, preferably an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines, or combinations thereof;

(e) optionally up to 25 wt. %, based on the total weight of the composition, of at least one solid or filler that is different from (c) and (d);

(f) optionally at least one dye; and (g) water in an amount that is sufficient to convert at least 60 wt. %, preferably at least 70 wt. %, more preferably at least 80 wt. %, most preferably at least 100 wt. %, of the sodium acetate (a) to sodium acetate trihydrate.

6. A solid, particulate composition comprising (a) 12 to 57 wt. %, based on the total weight of the composition, sodium acetate;

(b) 0.1 to 10 wt. % of at least one fragrance;

(c) 0.1 to 25 wt. %, preferably 0.5 to 3 wt. %, based on the total weight of the composition, of an inorganic rheology modifier, preferably an inorganic rheology modifier from the group of pyrogenic silicic acids and/or of an organic rheology modifier, preferably an organic rheology modifier from the group of celluloses, preferably microfibrillated celluloses;

(d) optionally up to 25 wt. %, based on the total weight of the composition, of an emulsifier, preferably an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines, or combinations thereof;

(e) optionally up to 25 wt. %, based on the total weight of the composition, of at least one solid or filler that is different from (c) and (d);

(f) optionally at least one dye; and (g) water in an amount that is sufficient to convert at least 60 wt. %, preferably at least 70 wt. %, more preferably at least 80 wt. %, most preferably at least 100 wt. %, of the sodium acetate (a) to sodium acetate trihydrate.

7. The composition according to one of points 5 or 6, characterized in that the sodium acetate is contained in the composition in an amount of from 18 to 57 wt. %, preferably from 24 to 48 wt. %, in particular from 27 to 45 wt. %, based on the total weight of said composition.

8. A solid, particulate composition comprising (a) 20 to 95 wt. %, based on the total weight of the composition, sodium acetate trihydrate;

(b) 0.1 to 10 wt. % of at least one fragrance;

(c) 0.1 to 25 wt. %, based on the total weight of the composition, of at least one, preferably solid, rheology modifier of such a type and in such an amount that a melt obtained by heating the composition to 70° C. has a yield point above 1 Pa, preferably above 5 Pa and in particular above 10 Pa;

(d) optionally up to 25 wt. %, based on the total weight of the composition, of an emulsifier, preferably an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines, or combinations thereof;

(e) optionally up to 25 wt. %, based on the total weight of the composition, of at least one solid or filler that is different from (c) and (d); and (f) optionally at least one dye.

9. A solid, particulate composition comprising (a) 20 to 95 wt. %, based on the total weight of the composition, sodium acetate trihydrate;

(b) 0.1 to 10 wt. % of at least one fragrance;

(c) 0.1 to 25 wt. %, preferably 0.5 to 3 wt. %, based on the total weight of the composition, of an inorganic rheology modifier, preferably an inorganic rheology modifier from the group of pyrogenic silicic acids and/or of an organic rheology modifier, preferably an organic rheology modifier from the group of celluloses, preferably microfibrillated celluloses;

(d) optionally up to 25 wt. %, based on the total weight of the composition, of an emulsifier, preferably an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines, or combinations thereof;

(e) optionally up to 25 wt. %, based on the total weight of the composition, of at least one solid or filler that is different from (c) and (d); and (f) optionally at least one dye.

10. The composition according to one of points 8 or 9, characterized in that the sodium acetate trihydrate is contained in the composition in an amount of from 30 to 95 wt. %, preferably from 40 to 90 wt. %, in particular from 45 to 90 wt. %, based on the total weight of said composition.

11. The composition according to one of the preceding points, characterized in that the at least one fragrance is present in the composition in an amount of from 1 to 20 wt. %, preferably 1 to 15 wt. %, more preferably 3 to 12 wt. %.

12. The composition according to one of the preceding points, characterized in that the at least one fragrance is used is used in the form of fragrance capsules and/or perfume oils.

13. The composition according to one of the preceding points, characterized in that the composition contains, based on its total weight, an inorganic rheology modifier in an amount of from 1 to 2.5 wt. %, more preferably 1.2 to 2.0 wt. %.

14. The composition according to one of the preceding points, characterized in that the composition contains, as an inorganic rheology modifier, pyrogenic silicic acid having a BET surface area of more than 50 $m^2/g$, preferably more than 100 $m^2/g$, more preferably 150 to 250 $m^2/g$, in particular 175 to 225 $m^2/g$.

15. The composition according to one of the preceding points, characterized in that the composition contains, based on its total weight, an organic rheology modifier in an amount of from 1 to 2.5 wt. %, more preferably 1.2 to 2.0 wt. %.

16. The composition according to one of the preceding points, characterized in that the composition contains, as an organic rheology modifier, cellulose, preferably microfibrillated cellulose.
17. The composition according to one of the preceding points, characterized in that components (c) and (d) are, independently of one another, contained in the composition in amounts of from 0 to 25 wt. %, preferably up to 20 wt. %, more preferably up to 18 wt. %, in particular up to 15 wt. %, based on the total weight of said composition.
18. The composition according to one of the preceding points, characterized in that the composition further contains at least one dye, preferably in a concentration of from 0.001 to 0.5 wt. %, particularly preferably 0.01 to 0.3 wt. %, based on the total weight of the composition.
19. The composition according to one of the preceding points, characterized in that the composition does not contain a polyethylene glycol which is solid at room temperature (25° C.) in the form of a coating.
20. The composition according to one of the preceding points, characterized in that the composition contains less than 1 wt. %, based on the total weight, of a polyethylene glycol which is solid at room temperature (25° C.).
21. The composition according to one of the preceding points, characterized in that the composition further contains free water.
22. The composition according to one of the preceding points, characterized in that the composition is present in the form of hemispherical particles.
23. The composition according to one of the preceding points, characterized in that at least 20 wt. %, preferably at least 40 wt. %, more preferably at least 60 wt. % and particularly preferably at least 80 wt. %, of the composition consists of particles which have a spatial extension of between 0.5 and 10 mm, in particular 0.8 to 7 mm and particularly preferably 1 to 3 mm, in any spatial direction.
24. The composition according to one of the preceding points, characterized in that at least 20 wt. %, preferably at least 40 wt. %, more preferably at least 60 wt. % and particularly preferably at least 80 wt. %, of the composition consists of particles in which the ratio of the longest particle diameter determined in any spatial direction to the shortest diameter determined in any spatial direction is between 3:1 and 1:1, preferably between 2.5:1 and 1.2:1 and in particular between 2.2:1 and 1.4:1.
25. The composition according to one of the preceding points, characterized in that at least 20 wt. %, preferably at least 40 wt. %, more preferably at least 60 wt. % and particularly preferably at least 80 wt. %, of the composition consists of particles which have a particle weight of between 2 and 150 mg, preferably between 4 and 60 mg and in particular between 5 and 10 mg.
26. The use of the solid composition according to one of points 1 to 25 as a textile care agent for fragrancing textile fabrics.
27. A washing or cleaning agent comprising a solid composition according to one of points 1 to 25.
28. A method for preparing the composition according to one of points 1 to 25, comprising:
    (a) producing a melt comprising the at least one water-soluble carrier material;
    (b) optionally metering in additional optional ingredients;
    (c) metering the at least one perfume, the at least one rheology modifier and optionally a dye into the melt;
    (d) mixing the melt and the at least one fragrance; and
    (e) cooling and optionally shaping the mixture to obtain perfume-containing melt bodies.
29. A method for preparing the composition according to one of points 1 to 25, comprising:
    (a) producing, preferably continuously producing and conveying, a melt comprising the at least one water-soluble carrier material;
    (b) optionally metering in additional optional ingredients;
    (c) metering, preferably continuously metering, the at least one perfume, the at least one rheology modifier and optionally a dye into the melt;
    (d) mixing the melt and the at least one fragrance;
    (e) applying drops of the resulting mixture to a cooling belt by means of a drop former having a rotating, perforated outer drum; and
    (f) solidifying the drops of the mixture on the steel strip to form solid melt bodies.
30. A method for the treatment of textiles, in the course of which a composition according to one of points 1 to 25 is metered into the wash liquor of a textile washing machine.

EXAMPLES

Example 1

The following table contains an example of a formulation according to the invention (all quantities in wt. %)

TABLE 1

| Compositions | | |
|---|---|---|
| Sodium acetate trihydrate | 84.70 | |
| Sodium acetate (water-free) | | 56.0 |
| Hydrophilic pyrogenic silicic acid (Aerosil 200) | 1.50 | |
| C16/18 fatty alcohol 30 EO | 0.80 | |
| Microfibrillated cellulose (2% in water) | | 29.2 |
| Perfume | 4.5 | 0.9 |
| Perfume capsule slurry (50%) | 5.5 | 5.8 |
| Dye | | 0.1% |
| Water | up to 100 | up to 100 |

For preparation, the sodium acetate trihydrate was heated to a temperature of 70° C. and largely dissolved, by stirring, in its removed water of crystallization. Subsequently, the other constituents were incorporated. Using water-free acetate, the solution was prepared by stirring it, at 70° C., together with the formulation water and the microfibrillar cellulose containing 98% water. Pastilles were prepared by dropping the liquid mixture ("melt") onto a cooling plate that is temperature-controlled to room temperature (23° C.).

The yield point of the cellulose-containing formulation specified above was measured as specified in the description. Said yield point was 20 Pa. The thus prepared fragrance pastilles according to the invention were able to be dropped to form uniform hemispherical pastilles without dissolving.

Viscosities and a yield point were measured using a rotation rheometer (AR G2 from TA Instruments or a "Kinexus" from Malvern).

A plate-plate measuring system with 40 mm diameter and 1.1 mm plate spacing was used. The yield point was determined in a step-flow procedure in which the shear stress was increased quasistatically, i.e. by waiting for the equilibrium deformation or steady flow, from the smallest possible value to a value above the yield point. The deformation is plotted against the shear stress in a log-log graph. If a yield point is present, the curves thus obtained have a characteristic deviation. An exclusively elastic deformation takes place below the deviation. The gradient of the curve in the double logarithmic representation is ideally one. Above the deviation, the gradient of the curve suddenly increases and there is steady flow. The shear stress value of the deviation corresponds to the yield point. If the deviation is not very sharp, the point of intersection of the tangents of the two curve portions can be used to determine the yield point.

In the case of liquids that have no yield point, the graph described above is usually curved to the right.

What is claimed is:

1. A solid, particulate composition comprising (a) 20 to 95 wt. %, based on the total weight of the composition, of at least one water-soluble carrier material selected from water-containing salts of which the water vapor partial pressure corresponds, at a specific temperature in the range from 30 to 100° C., to the $H_2O$ partial pressure of the saturated solution of said salt at the same temperature, (b) 0.1 to 20 wt. % of at least one fragrance, (c) 0.1 to 25 wt. %, based on the total weight of the composition, of at least one-rheology modifier of such a type and in such an amount that a melt obtained by heating the composition to 70° C. has a yield point above 1 Pa;

(d) optionally up to 25 wt. % of an emulsifier;

(e) optionally up to 25 wt. %, based on the total weight of the composition, of at least one solid or filler that is different from (c) and (d);

(f) optionally at least one dye.

2. The composition according to claim 1, wherein the water-soluble carrier material (A) is selected from water-containing salts of which the water vapor partial pressure corresponds, at a temperature in the range from 40 to 90° C. to the $H_2O$ partial pressure of the saturated solution of said salt; and/or (B) is contained in the composition in an amount from 30 to 95 wt %, based on the total weight of said composition.

3. The composition according to claim 1, wherein the at least one fragrance (A) is contained in the composition in an amount from 1 to 20 wt. %; and/or (B) is used in the form of fragrance capsules and/or perfume oils.

4. The composition according to claim 1, wherein it comprises, based on its total weight, 1 to 25 wt. %, of an inorganic rheology modifier and/or of an organic rheology modifier.

5. The composition according to claim 4 wherein it comprises an inorganic rheology modifier from the group of pyrogenic silicic acids and/or an organic rheology modifier from the group of celluloses.

6. The composition according to claim 4 wherein it comprises microfibrillated celluloses.

7. The composition according to claim 1, wherein pyrogenic silicic acid (A) is contained in the composition in an amount from 1 to 2.5 wt. %; and/or (B) has a BET surface area of more than 50 $m^2/g$.

8. The composition according to claim 1, wherein it further contains at least one dye.

9. The composition according to claim 8, wherein it further contains at least one dye in a concentration from 0.001 to 0.5 wt. % based on the total weight of the composition.

10. The composition according to claim 8, wherein it further contains at least one dye in a concentration from 0.01 to 0.3 wt. % based on the total weight of the composition.

11. The composition according to claim 1, wherein it further contains free water.

12. The composition according to claim 1, wherein it comprises a solid rheology modifier.

13. The composition according to claim 1, wherein it comprises an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines, or combinations thereof.

14. The composition according to claim 1, wherein the water-containing salt is sodium acetate trihydrate ($Na(CH_3COO).3H_2O$).

15. A method for preparing the composition according to claim 1, comprising:

(a) producing a melt comprising the at least one water-soluble carrier material;

(b) optionally metering in additional optional ingredients;

(c) metering the at least one perfume, at least one rheology modifier and optionally a dye into the melt;

(d) mixing the melt and the at least one fragrance; and (e) cooling and optionally shaping the mixture to obtain perfume-containing melt bodies.

16. A washing or cleaning agent comprising a solid composition according to claim 1.

* * * * *